United States Patent [19]

Hashimoto et al.

[11] Patent Number: 5,017,965

[45] Date of Patent: May 21, 1991

[54] CHARGING MEMBER AND ELECTROPHOTOGRAPHIC APPARATUS USING THE SAME

[75] Inventors: Yuichi Hashimoto, Tokyo; Takashi Koyama, Yokohama, both of Japan

[73] Assignee: Canon Kabushiki Kaisha, Japan

[21] Appl. No.: 548,221

[22] Filed: Jul. 5, 1990

[30] Foreign Application Priority Data

Jul. 5, 1989 [JP] Japan ..... 1-73225

[51] Int. Cl.[5] ..... G03G 15/02; G03G 13/02

[52] U.S. Cl. ..... 355/219; 29/130; 29/132; 361/225; 430/35

[58] Field of Search ..... 355/219; 118/644, 647–651, 118/661; 430/35; 29/130, 132; 361/225

[56] References Cited

U.S. PATENT DOCUMENTS

| | | | |
|---|---|---|---|
| 3,737,310 | 6/1973 | Snelling et al. | 430/35 |
| 3,784,294 | 1/1978 | Wells | 430/35 X |
| 4,259,003 | 3/1981 | Mangal et al. | 355/210 |
| 4,494,857 | 1/1985 | Ueno et al. | 355/210 |
| 4,727,453 | 2/1988 | Ewing | 361/225 |
| 4,922,299 | 5/1990 | Uchimoto et al. | 355/219 |
| 4,959,688 | 9/1990 | Koitabashi | 355/219 |
| 4,967,231 | 10/1990 | Hosoya et al. | 355/219 |

FOREIGN PATENT DOCUMENTS

| | | | |
|---|---|---|---|
| 0148468 | 7/1986 | Japan | 355/219 |
| 0172858 | 7/1989 | Japan | 355/219 |
| 0179958 | 7/1989 | Japan | 355/219 |
| 0179959 | 7/1989 | Japan | 355/219 |
| 1261675 | 10/1989 | Japan | 355/219 |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

A charging member having a surface layer which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

11 Claims, 2 Drawing Sheets

CHARGING MEMBER AND ELECTROPHOTOGRAPHIC APPARATUS USING THE SAME

FIELD OF THE INVENTION AND RELATED ART

The present invention relates to a charging member suitably used for charging an electrophotographic photosensitive member for the purpose of primary charging, transfer charging, charge-removing charging, etc., and to an electrophotographic apparatus using such a charging member.

In the conventional charging step included in electrophotographic processes using an electrophotographic photosensitive member, in most cases, a high voltage (DC voltage of about 5–8KV) is applied to a metal wire to generate a corona, which is used for the charging. In this method, however, a corona discharge product such as ozone and NOx is generated along with the generation of the corona. Such a corona discharge product deteriorates the photosensitive member surface to cause image quality deterioration such as image blur (or image fading). Further, because the contamination on the metal wire affects the image quality, there has been posed a problem such that white droppings (or white dropouts) or black streaks occur in the resultant copied image.

Moreover, the proportion of the current directed to the photosensitive member is generally 5–30% of the consumed current, and most thereof flows to a shield plate disposed around the metal wire. As a result, the conventional corona charging method has been low in electric power efficiency.

Therefore, in order to solve the above-mentioned problems, there has been researched a contact charging method wherein a charging member is caused to directly contact a photosensitive member to charge the photosensitive member, as disclosed in Japanese Laid-Open Patent Application (JP-A, KOKAI) Nos. 178267/1982, 104351/1981, 40566/1983, 139156/1983, 150975/1983, etc.

However, in practice, even when a photo-sensitive member is charged by using the above-mentioned contact charging method, the photosensitive member surface is not evenly charged to cause charging unevenness in the form of spots. Accordingly, e.g., in a reversal development system, when the photosensitive member, having the charging unevenness in the form of spots is subjected to an electrophotographic process including an image exposure step, et seq., the output image includes black spot-like images (black spots) corresponding to the above-mentioned spot-like charging unevenness. On the other hand, a normal development system only provides an output image including white spot-like image (white spots). As a result, it has been difficult to obtain a high-quality image.

Further, in spite of the above-mentioned many proposals, an electrophotographic apparatus utilizing the direct (or contact) charging method has never been put on the market up to the present. The reason for this is, e.g., that the conventional direct charging method cannot charge a photosensitive member uniformly but causes a dielectric breakdown of the photosensitive member due to the direct application of a voltage. When the dielectric breakdown occurs to provide one breakdown point, e.g., in a cylindrical photosensitive member, charges provided on the whole contact portion along with the axis direction thereof flow into the breakdown point to cause charging failure.

SUMMARY OF THE INVENTION

An object of the present invention is to provide a charging member capable of stably providing high-quality images without causing spot-like fog due to charging unevenness or image defect due to dielectric breakdown in a photosensitive member.

Another object of the present invention is to provide a charging member capable of stably providing high-quality images even under a high temperature—high humidity condition.

A further object of the present invention is to provide an electrophotographic apparatus using the above-mentioned charging member.

According to the present invention, there is provided a charging member comprising a surface layer, which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

The present invention also provides a charging member comprising a base layer and a surface layer disposed thereon; the base layer having a volume resistivity in the range of $10^0$–$10^{11}$ ohm.cm which is smaller than that of the surface layer; the surface layer having volume resistivity in the range of $10^6$–$10^{12}$ ohm.cm and comprising a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

The present invention further provides a device unit to be detachably disposed in an apparatus body, which comprises a photosensitive member and at least one charging member assembled together with the photosensitive member; the charging member comprising a surface layer which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

The present invention further provides an electrophotographic apparatus comprising a photosensitive member, latent image-forming means for forming a latent image on the photosensitive member, means for developing the latent image to form a developed image, and means for transferring the developed image to a transfer material; the latent image-forming means comprising a charging member disposed in contact with the photosensitive member; the charging member comprising a surface layer which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

The present invention further provides a facsimile comprising an electrophotographic apparatus and receiving means for receiving image information from a remote terminal; the electrophotographic apparatus comprising a photosensitive member, latent image-forming means for forming a latent image on the photosensitive member, means for developing the latent image to form a developed image, and means for transferring the developed image to a transfer material; the latent image-forming means comprising a charging member disposed in contact with the photosensitive member; the charging member comprising a surface layer which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

In the present invention, the ratio between the amount of the isocyanate group and that of the hydroxyl group in the raw material for polyurethane is set as described above. Based on such a setting, the charging member according to the present invention may provide a stable potential characteristic and few image defects, and may reduce a leak due to a pin-hole. Further, the charging member according to the present invention may provide stable potential and image formation characteristics even under a high temperature —high humidity condition.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
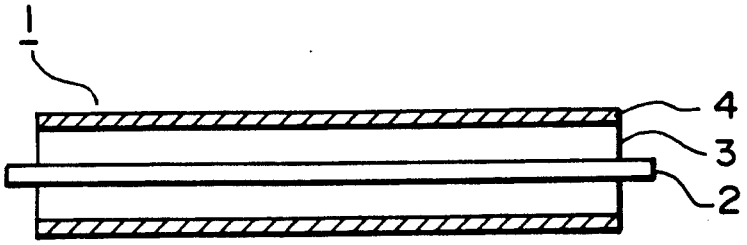
FIG. 1 is a schematic sectional view showing an embodiment of the charging member according to the present invention.

In a preferred embodiment of the present invention, the charging member has a multi-layer structure comprising a base layer, and a surface layer disposed thereon.

The volume resistivity of the surface layer may preferably be $10^6$ to $10^{12}$ ohm.cm. The surface layer may preferably have a volume resistivity which is higher than that of the base layer contacting the surface layer as described hereinafter, as described in Japanese Patent Application 230334/1987.

The material constituting the base layer may include: metals such as aluminum, iron and copper; electroconductive polymer materials such as polyacetylene, polypyrrole and polythiophene; rubbers or insulating resins supplied with electroconductivity, e.g., by dispersing therein electroconductive particles such as carbon and metal; and insulating resins or rubbers such as polycarbonate and polyester having a surface laminated or coated with a metal or another conductive material. The base layer may comprise a single layer or two or more layers. The volume resistivity of the base layer may preferably be $10^0$–$10^{11}$ ohm.cm, particularly $10^2$–$10^{10}$ ohm.cm.

In the present invention, the surface layer to be disposed on the above-mentioned base layer (or electroconductive material) comprises a polyurethane resin. The polyurethane resin content in the surface layer may preferably be 30 wt. % or higher, more preferably 50 wt. % or higher, based on the weight of the surface layer. Such a polyurethane resin may be prepared from a raw material for polymer including a polyol compound and an isocyanate compound as described below.

The polyol compound may be a compound having an end (or terminal) hydroxyl group in its main chain and/or side chain. Specific examples thereof may include: copolymers comprising a unit for a polymer such as polyester resin, polyether resin, epoxy resin, polyvinyl acetate, and vinyl acetate derivative; polyvinyl alcohol, cellulose acetate, nitrocellulose, alkyd resin, phenolic resin, xylene resin, polyvinyl butyral, etc. These hydroxyl group-containing compounds may be used singly or as a mixture of two or more species thereof.

Specific examples of the isocyanate compound having at least two isocyanate groups may include: aromatic isocyanate compounds such as tolylene diisocyanate, meta-xylylene diisocyanate, diphenylmethane diisocyanate; polymethylene-polyphenyl diisocyanate; hydrogenated products of these isocyanate compounds; aliphatic isocyanate compounds such as hexamethylene diisocyanate; and blocked isocyanate compounds obtained by blocking the isocyanate group of the above-mentioned isocyanate compounds with another compound such as phenol, ketoxime, aromatic secondary amine, tertiary alcohol, amide, lactam, heterocyclic compound, and sulfurous acid salt (or sulfite).

The above-mentioned polyol compound and isocyanate compound can be dissolved in an appropriate solvent such as benzene, toluene, nitrobenzene, dibutyl ether, methyl ethyl ketone, and applied onto a prescribed layer so as not to affect the layer at the time of molding. Alternatively, a polyurethane elastomer may be dissolved in a solvent such as N-methylpyrrolidone, dimethylacetamide, DMF (dimethylformamide), pyridine, and benzyl alcohol, and may again be subjected to molding.

A catalyst promoting or accelerating the formation of a polymer can be added to the material to be used for forming the surface layer. Specific examples thereof may include naphthenic acid salts such as magnesium naphthenate and cobalt naphthenate; organotin compounds such as dibutyltin laurate and dimethyltin laurate; and amine compounds such as N-methylmorpholine, and N,N,N',N'-tetramethyl polymethylene diamine. The addition amount of the catalyst may preferably be 0.001 to 5 wt. % based on the weight of the polymer.

In the raw material for a prescribed polymer to be used in the present invention, the mol ratio between the isocyanate group (NCO group) and the hydroxyl group (OH group) satisfies the following formula:

$$1.0 < (\text{mol of NCO group})/(\text{mol of OH group}) \leqq 2.0.$$

If the mol ratio is 1.0 or smaller, the volume resistivity of the surface layer is lowered. If the mol ratio exceeds 2.0, the adhesion property of the resultant coating film is deteriorated. In the present invention, the above-mentioned mol ratio may preferably satisfy the following formula:

$$1.0 < (\text{mol of NCO group})/(\text{mol of OH group}) \leqq 1.5.$$

In the present invention, the volume resistivity of the surface layer may be controlled by mixing plural species of polyol compounds having different average molecular weights; by mixing plural species of polyol compounds having different numbers of functional groups; or by adding an electrolyte component such as inorganic salt and organic salt.

The charging member for electrophotography according to the present invention which comprises the above-mentioned surface layer comprising a prescribed polyurethane resin little changes its volume resistivity even under a high temperature—high humidity condition, and is capable of providing stable charging ability without influence of a humidity change in the atmosphere.

In the present invention, the surface layer may preferably have a film thickness of 1–500 microns, more preferably 20–200 microns.

The form or shape of the charging member according to the present invention may be any of roller, brush, blade, belt, etc. The form of the charging member can appropriately be selected corresponding to the specifications and form of an electrophotographic apparatus using it. Among these, a roller form is preferred in view of uniformity in charging.

FIG. 1 shows a schematic sectional view of an embodiment of the electrophotographic charging member 1 according to the present invention having a roller form. In this embodiment, the charging member 1 basically comprises an electroconductive substrate 2, and a base layer 3 and a surface layer 4 disposed in this order on the substrate 2.

The electroconductive substrate 2 constituting the central shaft of the charging member 1 in this embodiment may comprise an electroconductive resin or a metal such as iron, copper, stainless steel, aluminum, and aluminum alloy. The substrate 2 may have a cylindrical shape, plate-like shape, etc. Another layer such as adhesive layer may further be disposed between the electroconductive substrate 2 and the base layer 3, and/or between the base layer 3 and the surface layer 4, as desired.

The charging member 1 may be prepared, e.g., by successively forming a base layer 3 and a surface layer 4 on an electroconductive substrate 2 by molding or coating; or by forming a base layer 3 and a surface layer 4 and then introducing or inserting an electroconductive substrate 2 into the center of the resultant product.

Figure 2:
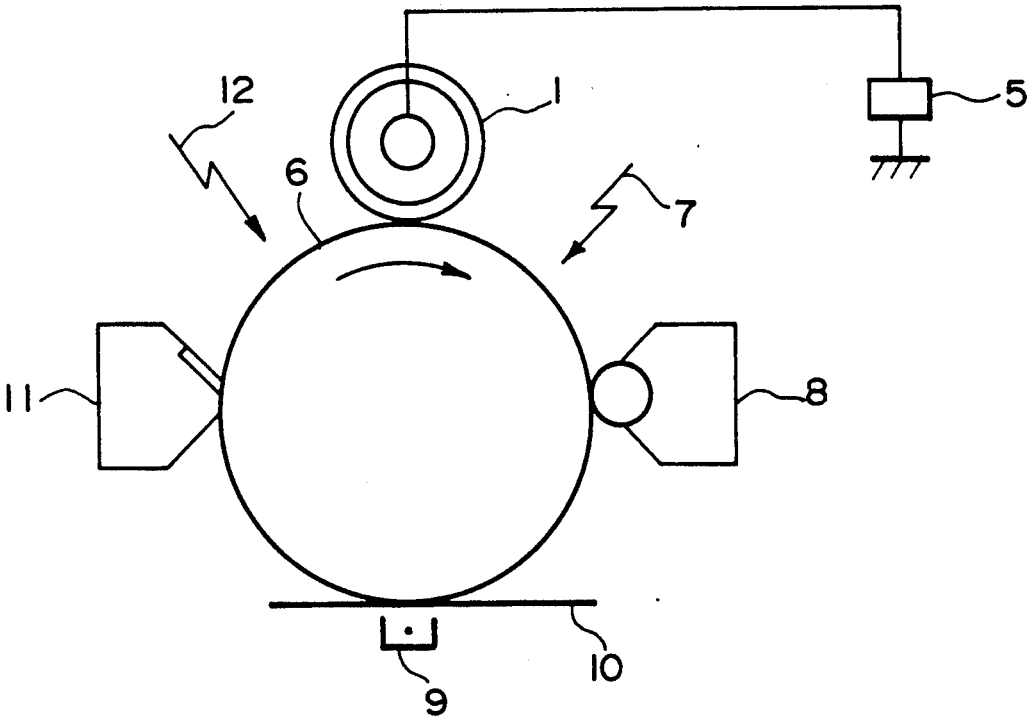
FIG. 2 is a schematic sectional view showing an electrophotographic apparatus using the charging member according to the present invention.

The charging member 1 according to the present invention may be used in an electrophotographic apparatus as shown in FIG. 2 so as to charge an electrophotographic photosensitive member 6.

When the photosensitive member 6 is charged, by using the charging member 1 according to the present invention, a voltage is externally applied to the charging member 1 disposed in contact with the photosensitive member 6 by means of an external power supply 5 connected to the charging member 1, thereby to charge the photosensitive member 6.

Further, image formation may be effected by means of such an electrophotographic apparatus using the charging member 1 in the following manner.

Referring to FIG. 2, a voltage is externally applied to the charging member 1 disposed in contact with the photosensitive member 6 by means of an external power supply 5 connected to the charging member 1, thereby to charge the surface of the photosensitive member 6, and the photosensitive member 6 is imagewise exposed to light 7 corresponding to an original image by the image exposure means, thereby to form an electrostatic latent image on the photosensitive member 6. Then, the electrostatic latent image formed on the photosensitive member 6 is developed or visualized by attaching the toner or developer contained in a developing device 8 to the photosensitive member 6 thereby to form a toner image on the photosensitive member 6. The toner image is then transferred to a transfer-receiving material (or transfer material) 10 such as paper by means of a transfer charger 9 to form a toner image thereon. The residual toner which remains on the photosensitive member 6 without transferring to the transfer-receiving material 10 at the time of the transfer operation is recovered by means of a cleaner 11.

Thus, the copied image is formed by such an electrophotographic process. In a case where residual charges remain on the photosensitive member 6, the photosensitive member 6 may preferably be exposed to light 12 by the pre-exposure means to remove the residual charge, prior to the above-mentioned primary charging.

The light source for providing light 7 for image exposure may be a halogen lamp, a fluorescent lamp, a laser, an LED, etc. The development system may be either a normal development system or a reversal development system.

The arrangement of the charging member 1 should not particularly be restricted. More specifically, such an arrangement may include: one wherein the charging member 1 is fixed; or one wherein the charging member 1 is moved or rotated in the same direction as, or in the counter direction to, that of the movement of the photosensitive member 6.

The charging member 1 according to the present invention may be used not only for the primary charging step but also for the transfer charging step or charge-removing (or discharging) step requiring a charging operation.

In the present invention, a plurality of elements or components of an electrophotographic apparatus such as the above-mentioned photosensitive member, developing means and cleaning means may be integrally assembled into a device unit, and the device unit may be detachably disposed in the apparatus body. For example, at least one component selected from a photosensitive member, a developing means of and a cleaner may be integrally assembled in a device unit, and such a device unit is detachably disposed in the apparatus body by the medium of a guiding means such as rail of the apparatus body. In such an embodiment, a charger and/or a developing means may further be assembled in the above-mentioned device unit.

Figure 3:
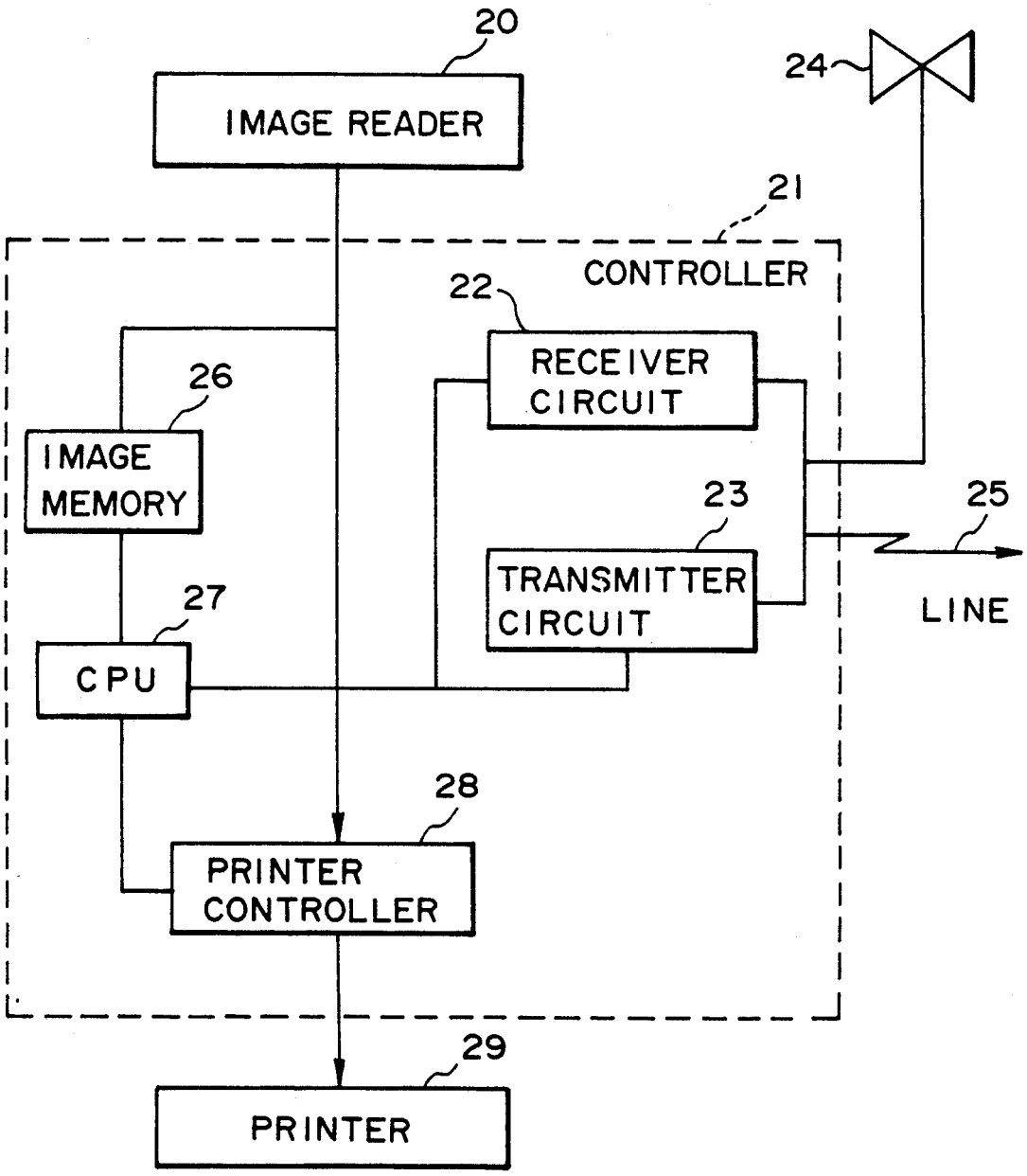
FIG. 3 is a block diagram showing a facsimile machine using the electrophotographic apparatus according to the present invention as a printer

In a case where an electrophotographic apparatus including the charging member according to the present invention is used as a printer for facsimile, the above-mentioned image exposure means corresponds to that for printing received data. FIG. 3 shows such an embodiment by using a block diagram.

Referring to FIG. 3, a controller 21 controls an image reader (or image reading unit) 20 and a printer 29. The entirety of the controller 21 is regulated by a CPU 27. Read data from the image reader 20 is transmitted through a transmitter circuit 23 to another terminal such as facsimile. On the other hand, data received from another terminal such as facsimile is transmitted through a receiver circuit 22 to the printer 29. An image memory 26 stores prescribed image data. A printer controller 28 controls the printer 29. In FIG. 3, reference numeral 24 denotes a telephone system.

More specifically, an image received from a line (or circuit) 25 (i.e., image information received from a remote terminal connected by the line) is demodulated by means of the receiver circuit 22, decoded by the CPU 27, and sequentially stored in the image memory 26. When image data corresponding to at least one page is stored in the image memory 26, image recording is effected with respect to the corresponding page. The CPU 27 reads image data corresponding to one page from the image memory 26, and transmits the decoded data corresponding to one page to the printer controller 28. When the printer controller 28 receives the image data corresponding to one page from the CPU 27, the printer controller 28 controls the printer 29 so that image data recording corresponding to the page is effected. During the recording by the printer 29, the CPU 27 receives another image data corresponding to the next page.

Thus, receiving and recording of an image may be effected by mean of the apparatus shown in FIG. 3 in the above-mentioned manner.

In the present invention, the voltage applied to the charging member 1 may preferably be one in the form of a pulsation (or pulsating current) voltage obtained by superposing an AC voltage on a DC voltage. In such a case, there may preferably be used a pulsation voltage obtained by superposing a DC voltage of ±200V to ±1500V on an AC voltage having a peak-to-peak voltage of 2000V or below. The voltage applied to the charging member 1 may also be a DC voltage or an AC voltage.

The method for applying such a voltage, while also varying depending on the specifications of respective electrophotographic apparatus, may include: one wherein a desired voltage is instantaneously applied; one wherein the applied voltage is gradually or stepwise raised in order to protect a photosensitive member; or one wherein a DC voltage and an AC voltage are applied in a sequence of from DC voltage to AC voltage, or of from AC voltage to DC voltage, when a superposition of a DC voltage and an AC voltage is applied to the charging member.

The member to be charged by means of the charging member according to the present invention may be an electrophotographic photosensitive member. Such an electrophotographic photosensitive member may for example be constituted in the following manner.

The photosensitive member for electrophotography may comprise an electroconductive substrate and a photosensitive layer disposed thereon. The electroconductive substrate may be a substrate which per se has an electroconductivity such as that of a metal inclusive of aluminum, aluminum alloy, stainless steel and nickel; alternatively, a substrate of a plastic coated with, e.g., a vapor-deposited layer of aluminum, aluminum alloy, or indium oxide-tin oxide alloy; substrate coated with a mixture of an appropriate binder and electroconductive powder such as tin oxide or carbon black; or a plastic substrate having an electroconductive binder layer.

Between the electroconductive substrate and the photosensitive layer, there may be formed a primer or undercoat layer having a barrier function and an adhesive function. The primer layer may be formed of, e.g., casein, polyvinyl alcohol, nitrocellulose, ethylene-acrylic acid copolymer, polyamide (nylon 6, nylon 66, nylon 610, copolymer nylon, etc.), polyurethane, gelatin, or aluminum oxide. The thickness of the primer layer should preferably be 5 microns or below, particularly 0.5 to 3 microns. The primer layer may preferably have a volume resistivity of $10^7$ ohm.cm or above, in order to fully perform its function.

The photosensitive layer may for example be formed by applying an organic or inorganic photoconductive material together with a binder as desired, or by vacuum vapor deposition such as vacuum evaporation. In the present invention, there may preferably be used a photosensitive layer having a laminate structure comprising function-separated charge generation layer and charge transport layer. The charge transport layer may for example be disposed on the charge generation layer.

The charge generation layer may comprise a charge-generating substance such as azo pigments, phthalocyanine pigments, quinone pigments and perylene pigments. The charge generation layer may be formed by vapor-depositing such a charge-generating substance, or by applying a coating material comprising such a charge-generating substance together with an appropriate binder as desired, while the binder is omissible.

The charge generation layer may generally have a thickness of 0.01–5 microns, preferably 0.05–2 microns.

The charge transport layer may comprise a resin having a film-formability and a charge-transporting substance dissolved or dispersed therein. The charge-transporting substance used in the present invention may include hydrazone compounds, styryl compounds, oxazole compounds, and triarylamine compounds. The charge transport layer may generally have a thickness of 5–50 microns, preferably 10–30 microns.

Further, a protective layer may further be provided on the photosensitive layer, as desired, so as to prevent the deterioration due to ultraviolet rays, etc.

The charging member for electrophotography according to the present invention may be used not only for ordinary copying machines but also in the fields related to electrophotography such as laser printers, CRT printers and electrophotographic plate-making system.

The present invention will be explained in more detail with reference to examples. In the description appearing hereinafter, "parts" denotes "parts by weight".

EXAMPLE 1

First, a charging member was prepared in the following manner.

100 parts of chloroprene rubber (trade name: Denka-Chloroprene, mfd. by Denki Kagaku Kogyo) and 5 wt. parts of electroconductive carbon (trade name: Ketjen Black, mfd. by Lion K.K.) were melt-kneaded and molded into a roller shape having a diameter of 20 mm and a length of 230 mm wherein a stainless steel shaft having a diameter of 6 mm and a length of 260 mm was disposed in the center portion, thereby to form a base layer of a roller-form charging member. The volume resistivity of the base layer was $3\times10^4$ ohm.cm, when measured at a temperature of 20° C. and a humidity of 50% according to JIS K6911.

Separately, 6.2 parts of poly(oxypropylene) triol (hydroxyl value=114.5 mg KOH/g average molecular weight=1500) and 0.02 part of dibutyltin dilaurate were dissolved in 80 parts of methyl ethyl ketone, and to the resultant solution, 5.5 parts of blocked ketoxime compound (available NCO group content =11.6 wt. %) predominantly comprising hexamethylene diisocyanate was further added thereby to prepare a coating material having an (NCO/OH) mol ratio (i.e., (mol of NCO group)/(mol of OH group)) of 1.2.

The thus obtained coating liquid was applied onto the above-mentioned base layer by dip coating, and dried and hardened under heating at 120° C. for 60 min. to form a surface layer of charging member having a thickness of 200 microns), whereby a charging member was prepared. Separately, a surface layer was formed on an aluminum sheet in the same manner as described above, and its volume resistivity was measured.

The thus prepared charging member was assembled in an electrophotographic copying machine using a normal development system (trade name: PC-20, mfd. by Canon K.K.) so as to provide a system arrangement as shown in FIG. 2. The charging member according to the present invention was assembled in the copying machine instead of the primary corona charger as shown in FIG. 2.

In such an apparatus, a superposition of a DC voltage of −750V and an AC voltage having a peak-to-peak voltage of 1500V was used for the primary charging, whereby a dark part potential, and a light part potential were measured. In addition, a pin hole having a diameter of 1 mm was made in the photosensitive member, and the resultant image was evaluated. The above-mentioned items were measured at 20° C. and 50% RH.

More specifically, the dark part potential and light part potential were measured in the following manner.

The developing device of a copying machine was removed and a potential probe was placed at the developing device position. The dark part potential was measured by means of a surface electrometer under a condition under which image exposure was not effected. The light part potential was measured in the same manner as described above except that the image exposure was effected.

The results are shown in Table 1 appearing hereinafter.

Further, the volume resistivity of the surface layer of the charging member, potential characteristics and resultant images obtained by assembling the charging member in the above-mentioned copying machine were evaluated in the same manner as described above except that these items were evaluated under a high temperature—high humidity condition (temperature: 35° C.; humidity: 90%). The results are shown in Table 2 appearing hereinafter.

EXAMPLE 2

A charging member was prepared and evaluated in the same manner as in Example 1 except that a coating material for the surface layer prepared in the following manner was used instead of that used in Example 1.

7.85 parts of poly(oxypropylene) triol (hydroxyl value=114.5 mg KOH/g average molecular weight=1500) and 0.02 part of dibutyltin dilaurate were dissolved in 80 parts of methyl ethyl ketone, and to the resultant solution, 2.9 parts of a blocked ketoxime compound (available NCO group content=11.6 wt. %) predominantly comprising hexamethylene diisocyanate was further added, thereby to prepare a coating material having an (NCO/OH) mol ratio of 2.0.

The results are shown in Tables 1 and 2 appearing hereinafter.

EXAMPLE 3

A base layer for charging member was formed on a stainless steel shaft in the same manner as in Example 1.

Separately, 4.8 parts of poly(oxypropylene) polyol (hydroxyl value=118.1 mg KOH/g average molecular weight=1900) prepared by using pentaerythritol as an initiator, 9.6 parts of poly(oxypropylene)polyol (hydroxyl value=78.7 mg KOH/g average molecular weight=2800) prepared by using the same initiator as described above, 0.3 mol of triethylenediamine, and 3.0 parts of meta-xylylene diisocyanate were dissolved in 100 parts of isobutyl acetate, thereby to prepare a coating material having an (NCO/OH) mol ratio of 1.5.

The thus obtained coating liquid was applied onto the above-mentioned base layer by dip coating and dried at 100° C. for 60 min. to form a surface layer of charging member having a thickness of 200 microns, whereby a charging member was prepared.

The resultant charging member was evaluated in the same manner as in Example 1. The results are shown in Tables 1 and 2 appearing hereinafter.

EXAMPLE 4

A base layer for charging member was formed on a stainless steel shaft in the same manner as in Example 1.

Separately, 7.0 parts of polyester polyol (hydroxyl value=272 mg KOH/g average molecular weight =600) and 3.3 parts of tolylene diisocyanate were dissolved in 70 parts of 1,2-dichloroethane, thereby to prepare a coating material having an (NCO/OH) mol ratio of 1.1.

The thus obtained coating material was applied onto the above-mentioned base layer by dip coating and dried at 80° C. for 60 min. to form a surface layer of charging member having a thickness of 200 microns, whereby a charging member was prepared.

The resultant charging member was evaluated in the same manner as in Example 1. The results are shown in Tables 1 and 2 appearing hereinafter.

EXAMPLE 5

A base layer for charging member was formed on a stainless steel shaft in the same manner as in Example 1.

Separately, 19.3 parts of acrylic polyol (hydroxyl value=22 mg KOH/g, average molecular weight =8600) and 1.1 parts of hexamethylene diisocyanate were dissolved in 80 parts of methyl ethyl ketone, thereby to prepare a coating material having an (NCO-/OH) mol ratio of 1.1.

The thus obtained coating material was applied onto the above-mentioned base layer by dip coating and dried at 100° C. for 60 min. to form a surface layer of charging member having a thickness of 200 microns, whereby a charging member was prepared.

The resultant charging member was evaluated in the same manner as in Example 1. The results are shown in Tables 1 and 2 appearing hereinafter.

COMPARATIVE EXAMPLE 1

A base layer for charging member was formed on a stainless steel shaft in the same manner as in Example 1.

The resultant product as such was used as a charging member and evaluated in the same manner as in Example 1. The results are shown in Tables 1 and 2 appearing hereinafter.

COMPARATIVE EXAMPLE 2

A base layer for charging member was formed on a stainless steel shaft in the same manner as in Example 1.

Separately, 10 parts of chloroprene rubber (Denka Chloroprene, mfd. by Denki Kagaku Kogyo K.K.) and 0.2 parts of electroconductive carbon were added to 90 parts of methyl ethyl ketone and dispersed therein by means of a ball mill, thereby to prepare a dispersion.

The thus obtained dispersion was applied onto the above-mentioned base layer by dip coating and dried to form a surface layer of charging member having a thickness of 200 microns, whereby a charging member was prepared.

The resultant charging member was evaluated in the same manner as in Example 1. The results are shown in Tables 1 and 2 appearing hereinafter.

COMPARATIVE EXAMPLE 3

A base layer for charging member was formed on a stainless steel shaft in the same manner as in Example 1.

Separately, 10 parts of nylon-66 was dissolved in 90 parts of dimethylformamide, thereby to prepare a solution.

The thus obtained solution was applied onto the above-mentioned base layer by dip coating and dried at 100° C. for 60 min. to form a surface layer of charging member having a thickness of 200 microns, whereby a charging member was prepared.

The resultant charging member was evaluated in the same manner as in Example 1. The results are shown in Tables 1 and 2 appearing hereinafter.

COMPARATIVE EXAMPLE 4

A base layer for charging member was formed on a stainless steel shaft in the same manner as in Example 1.

Separately, 15 parts of poly(oxypropylene) triol (hydroxyl value=230 mg KOH/g, average molecular weight=1000) and 1 part of tolylene diisocyanate were dissolved in 80 parts of methyl ethyl ketone, thereby to prepare a coating material having an (NCO/OH) mol ratio of 0.2.

The thus obtained material was applied onto the above-mentioned base layer by dip coating and dried at 100° C. for 60 min. to form a surface layer of charging member having a thickness of 200 microns, whereby a charging member was prepared.

The resultant charging member was evaluated in the same manner as in Example 1. The results are shown in Tables 1 and 2 appearing hereinafter.

COMPARATIVE EXAMPLE 5

A base layer for charging member was formed on a stainless steel shaft in the same manner as in Example 1.

Separately, 16.5 parts of poly(oxypropylene) triol (hydroxyl value=230 mg KOH/g, average molecular weight=1000) and 0.1 part of tolylene diisocyanate were dissolved in 80 parts of methyl ethyl ketone, thereby to prepare a coating material having an (NCO-/OH) mol ratio of 2.2.

The thus obtained material was applied onto the above-mentioned base layer by dip coating and dried at 100° C. for 60 min. to form a surface layer of charging member having a thickness of 200 microns, whereby a charging member was prepared.

The resultant charging member was evaluated in the same manner as in Example 1. The results are shown in Tables 1 and 2 appearing hereinafter.

COMPARATIVE EXAMPLE 6

A base layer for charging member was formed on a stainless steel shaft in the same manner as in Example 1.

Separately, 18.8 parts of poly(oxypropylene) triol (hydroxyl value=230 mg KOH/g, average molecular weight=1000) and 0.1 part of tolylene diisocyanate were dissolved in 80 parts of methyl ethyl ketone, thereby to prepare a coating material having an (NCO-/OH) mol ratio of 2.5.

The thus obtained material was applied onto the above-mentioned base layer by dip coating and dried at 100° C. for 60 min. to form a surface layer of charging member having a thickness of 200 microns), whereby a charging member was prepared.

The resultant charging member was evaluated in the same manner as in Example 1. The results are shown in Tables 1 and 2 appearing hereinafter.

TABLE 1

| Example | Material for surface layer | Volume resistivity of surface layer (ohm · cm) (20° C. 50%) | Dark part potential (V) | Light part potential (V) | Image density | Image defect | Leak due to pin-hole |
|---|---|---|---|---|---|---|---|
| Ex. 1 | Polyether polyurethane (NCO/OH mol ratio = 1.2) | $2 \times 10^{10}$ | −710 | −110 | Normal | None | None |
| Ex. 2 | Polyether polyurethane (NCO/OH mol ratio = 2.0) | $5 \times 10^{11}$ | −705 | −110 | Normal | None | None |
| Ex. 3 | Polyether polyurethane (NCO/OH mol ratio = 1.5) | $8 \times 10^{9}$ | −690 | −130 | Normal | None | None |
| Ex. 4 | Polyether polyurethane (NCO/OH mol ratio = 1.1) | $9 \times 10^{11}$ | −695 | −115 | Normal | None | None |
| Ex. 5 | Acrylic polyurethane (NCO/OH mol ratio = 1.1) | $4 \times 10^{11}$ | −690 | −120 | Normal | None | None |
| Comp. Ex. 1 | Chloroprene*1 | $3 \times 10^{4}$ | −700 | −120 | Normal | *2 | *4 |
| Comp. Ex. 2 | Chloroprene*1 | $4 \times 10^{9}$ | −450 | −50 | Low | *3 | None |
| Comp. Ex. 3 | Nylon-66 | $8 \times 10^{13}$ | −400 | −50 | Low | *2 | None |
| Comp. Ex. 4 | Polyether polyurethane | $1 \times 10^{9}$ | −700 | −145 | Normal | *2 | None |
| Comp. Ex. 5 | Polyether polyurethane | $1 \times 10^{13}$ | −440 | −60 | Low | *2 | None |

TABLE 1-continued

| Example | Material for surface layer | Volume resistivity of surface layer (ohm · cm) (20° C. 50%) | Dark part potential (V) | Light part potential (V) | Image density | Image defect | Leak due to pin-hole |
|---|---|---|---|---|---|---|---|
| Comp. Ex. 6 | Polyether polyurethane (NCO/OH mol ratio = 2.5) | $7 \times 10^{13}$ | −300 | −40 | Low | *2 | None |

TABLE 2

| Example | Material for surface layer | Volume resistivity of surface layer (ohm · cm) (35° C. 90%) | Dark part potential (V) | Light part potential (V) | Image density | Image defect | Leak due to pin-hole |
|---|---|---|---|---|---|---|---|
| Ex. 1 | Polyether polyurethane (NCO/OH mol ratio = 1.2) | $9 \times 10^{9}$ | −700 | −100 | Normal | None | None |
| Ex. 2 | Polyether polyurethane (NCO/OH mol ratio = 2.0) | $1 \times 10^{10}$ | −680 | −95 | Normal | None | None |
| Ex. 3 | Polyether polyurethane (NCO/OH mol ratio = 1.5) | $5 \times 10^{8}$ | −690 | −110 | Normal | None | None |
| Ex. 4 | Polyester polyurethane (NCO/OH mol ratio = 1.1) | $2 \times 10^{10}$ | −680 | −90 | Normal | None | None |
| Ex. 5 | Acrylic polyurethane (NCO/OH mol ratio = 1.1) | $8 \times 10^{9}$ | −685 | −105 | Normal | None | None |
| Comp. Ex. 1 | Chloroprene*1 | $1 \times 10^{4}$ | −690 | −100 | Normal | *2 | *4 |
| Comp. Ex. 2 | Chloroprene*1 | $3 \times 10^{8}$ | −410 | −40 | Low | *3 | None |
| Comp. Ex. 3 | Nylon-66 | $4 \times 10^{12}$ | −230 | −40 | Low | *2 | None |
| Comp. Ex. 4 | Polyether polyurethane (NCO/KOH mol ratio = 0.2) | $7 \times 10^{5}$ | −260 | −75 | Low | *3 | None |
| Comp. Ex. 5 | Polyether polyurethane (NCO/OH mol ratio = 2.2) | $4 \times 10^{11}$ | −290 | −80 | Low | *3 | None |
| Comp. Ex. 6 | Polyether polyurethane (NCO/OH mol ratio = 2.5) | $9 \times 10^{12}$ | −200 | −50 | Low | *3 | None |

*1Chloroprene containing carbon dispersed therein.
*2Some white spots were observed.
*3Many white spots were observed.
*4Lateral streak and white dropouts occurred.

As shown in the above Tables 1 and 2, the charging member according to the present invention comprising a surface layer comprising a polyurethane resin corresponding to a suitable (NCO/OH) mol ratio exhibited stable charging characteristic, and provided suitable image density without causing image defect.

EXAMPLE 6

A charging member was prepared in the following manner.

100 wt. parts of chloroprene rubber and 5 wt. parts of electroconductive carbon were melt-kneaded and molded into a roller shape having a diameter of 20 mm and a length of 230 mm wherein a stainless steel shaft having a diameter of 6 mm and a length of 260 mm was disposed in the center portion, thereby to form a base layer of a roller-form charging member. The volume resistivity of the base layer was $1 \times 10^4$ ohm.cm when measured at a temperature of 35° C. and a humidity of 90% according to JIS K6911.

Separately, 6.2 parts of poly(oxypropylene) triol (hydroxyl value=114.5 mg KOH/g) and 0.02 part of dibutyltin dilaurate were dissolved in 80 parts of methyl ethyl ketone, and to the resultant solution, 5.5 parts of blocked ketoxime compound (available NCO group content=11.6 wt. %) comprising hexamethylene diisocyanate was further added, thereby to prepare a coating material having an (NCO/OH) mol ratio 1.2.

The thus obtained coating material was applied onto the above-mentioned base layer by dip coating and dried and hardened at 120° C. for 30 min. to form a surface layer of charging member having a thickness of 80 microns, whereby a charging member was prepared. Separately, a surface layer was formed on an aluminum sheet in the same manner as described above, and its volume resistivities was measured.

The thus prepared charging member was assembled in an electrophotographic copying machine using a reversal system (trade name: LBP-CX, mfd. by Canon K.K.) instead of the primary corona charger.

In such an apparatus, a superposition of a DC voltage of −750V and an AC voltage having a peak-to-peak voltage of 1500V was used for the primary charging, whereby a dark part potential, and a light part potential were measured. In addition, a pin hole having a diameter of 1 mm was made in the photosensitive member, and the resultant image was evaluated. The above-mentioned items were measured at 20° C. and 50% RH.

The results are shown in Table 3 appearing hereinafter.

Further, the volume resistivity of the charging member, potential characteristics and resultant images obtained by assembling the charging member in a laser printer using a reversal development system were evaluated in the same manner as described above except that these items were evaluated under a high temperature—high humidity condition (temperature: 35° C.; humidity: 90%). The results are shown in Table 4 appearing hereinafter.

EXAMPLE 7

A charging member was prepared and evaluated in the same manner as in Example 6 except that a coating material for the surface layer prepared in the following manner was used instead of that used in Example 6.

7.85 parts of poly(oxypropylene) triol (hydroxyl value=114.5 mg KOH/g) and 0.02 part of dibutyltin dilaurate were dissolved in 80 parts of methyl ethyl ketone, and to the resultant solution, 2.9 parts of blocked ketoxime compound (available NCO group content=11.6 wt. %) comprising hexamethylene diisocyanate was further added, thereby to prepare a coating material having an (NCO/OH) mol ratio of 2.0.

The results are shown in Tables 3 and 4 appearing hereinafter.

EXAMPLE 8

A base layer for charging member was formed on a stainless steel shaft in the same manner as in Example 6.

Separately, 4.8 parts of poly(oxypropylene)polyol (hydroxyl value=118.1 mg KOH/g) prepared by using pentaerythritol as an initiator, 9.6 parts of poly(oxypropylene)polyol (hydroxyl value=78.7 mg KOH/g) prepared by using the same initiator as described above, 0.3 part of triethylenediamine, and 3.0 parts of metaxylylene diisocyanate were dissolved in 100 parts of isobutyl acetate, thereby to prepare a coating material having an (NCO/OH) mol ratio of 1.5.

The thus obtained coating liquid was applied onto the above-mentioned base layer by dip coating and dried at 100° C. for 30 min. to form a surface layer of charging member having a thickness of 80 microns, whereby a charging member was prepared.

The resultant charging member was evaluated in the same manner as in Example 6. The results are shown in Table 3 and 4 appearing hereinafter.

EXAMPLE 9

A base layer for charging member was formed on a stainless steel shaft in the same manner as in Example 6.

Separately, 7.0 parts of polyester polyol (hydroxyl value=272 mg KOH/g) and 3.3 parts of tolylene diisocyanate were dissolved in 70 parts of 1,2-dichloroethane, thereby to prepare a coating material having an (NCO/OH) mol ratio of 1.1.

The thus obtained coating material was applied onto the above-mentioned base layer by dip coating and dried to form a surface layer of charging member having a thickness of 80 microns, whereby a charging member was prepared.

The resultant charging member was evaluated in the same manner as in Example 6. The results are shown in Table 3 and 4 appearing hereinafter.

EXAMPLE 10

A base layer for charging member was formed on a stainless steel shaft in the same manner as in Example 6.

Separately, 5.0 parts of acrylic polyol (hydroxyl value=17 mg KOH/g) and 5.5 parts of hexamethylene diisocyanate were dissolved in 80 parts of methyl ethyl ketone, thereby to prepare a coating material having an (NCO/OH) mol ratio of 1.1.

The thus obtained coating material was applied onto the above-mentioned base layer by dip coating and dried to form a surface layer of charging member having a thickness of 80 microns, whereby a charging member was prepared.

The resultant charging member was evaluated in the same manner as in Example 6. The results are shown in Table 3 and 4 appearing hereinafter.

COMPARATIVE EXAMPLE 7

A base layer for charging member was formed on a stainless steel shaft in the same manner as in Example 6.

The resultant product as such was used as a charging member and evaluated in the same manner as in Example 6. The results are shown in Tables 3 and 4 appearing hereinafter.

COMPARATIVE EXAMPLE 8

A base layer for charging member was formed on a stainless steel shaft in the same manner as in Example 6.

Separately, 10 parts of chloroprene rubber and 0.2 parts of electroconductive carbon were added to 90 parts of methyl ethyl ketone and dispersed therein by means of a ball mill, thereby to prepare a dispersion.

The thus obtained dispersion was applied onto the above-mentioned base layer by dip coating and dried to form a surface layer of charging member having a thickness of 80 microns, whereby a charging member was prepared.

The resultant charging member was evaluated in the same manner as in Example 6. The results are shown in Tables 3 and 4 appearing hereinafter.

COMPARATIVE EXAMPLE 9

A base layer for charging member was formed on a stainless steel shaft in the same manner as in Example 6.

Separately, 10 parts of nylon-66 was dissolved in 90 parts of dimethylformamide, thereby to prepare a solution.

The thus obtained solution was applied onto the above-mentioned base layer by dip coating and dried to form a surface layer of charging member having a thickness of 80 microns, whereby a charging member was prepared.

The resultant charging member was evaluated in the same manner as in Example 6. The results are shown in Tables 3 and 4 appearing hereinafter.

COMPARATIVE EXAMPLE 10

A base layer for charging member was formed on a stainless steel shaft in the same manner as in Example 6.

Separately, 15 parts of poly(oxypropylene)triol (hydroxyl value=230 mg KOH/g) and 1 part of tolylene diisocyanate were dissolved in 80 parts of methyl ethyl ketone, thereby to prepare a coating material having an (NCO/OH) mol ratio of 0.2.

The thus obtained material wa applied onto the above-mentioned base layer by dip coating and dried to form a surface layer of charging member having a thickness of 80 microns, whereby a charging member was prepared.

The resultant charging member was evaluated in the same manner as in Example 6. The results are shown in Tables 3 and 4 appearing hereinafter.

COMPARATIVE EXAMPLE 11

A base layer for charging member was formed on a stainless steel shaft in the same manner as in Example 6.

Separately, 16.5 parts of poly(oxypropylene)triol (hydroxyl value=230 mg KOH/g) and 0.1 part of tolylene diisocyanate were dissolved in 80 parts of methyl ethyl ketone, thereby to prepare a coating material having an (NCO/OH) mol ratio of 2.2.

The thus obtained material was applied onto the above-mentioned base layer by dip coating and dried to form a surface layer of charging member having a thickness of 80 microns, whereby a charging member was prepared.

The resultant charging member was evaluated in the same manner as in Example 6. The results are shown in Tables 3 and 4 appearing hereinafter.

COMPARATIVE EXAMPLE 12

A base layer for charging member was formed on a stainless steel shaft in the same manner as in Example 6.

Separately, 18.8 parts of poly(oxypropylene)triol (hydroxyl value=230 mg KOH/g) and 0.1 part of tolylene diisocyanate were dissolved in 80 parts of methyl ethyl ketone, thereby to prepare a coating material having an (NCO/OH) mol ratio of 2.5.

The thus obtained material was applied onto the above-mentioned base layer by dip coating and dried to form a surface layer of charging member having a thickness of 80 microns, whereby a charging member was prepared.

The resultant charging member was evaluated in the same manner as in Example 6. The results are shown in Tables 3 and 4 appearing hereinafter.

What is claimed is:

1. A charging member comprising a surface layer, which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

2. A member according to claim 1, wherein the surface layer has a volume resistivity of $10^6$ to $10^{12}$ ohm.cm.

3. A member according to claim 1, which comprises a base layer and the surface layer disposed thereon; the surface layer having a volume resistivity which is higher than that of the base layer.

TABLE 3

| Example | Material for surface layer | Volume resistivity of surface layer (ohm · cm) (20° C. 50%) | Dark part potential (V) | Light part potential (V) | Image density | Image defect | Leak due to pin-hole |
|---|---|---|---|---|---|---|---|
| Ex. 6 | Polyether polyurethane (NCO/OH mol ratio = 1.2) | $2 \times 10^{10}$ | −700 | −165 | Normal | None | None |
| Ex. 7 | Polyether polyurethane (NCO/OH mol ratio = 2.0) | $5 \times 10^{11}$ | −685 | −150 | Normal | None | None |
| Ex. 8 | Polyether polyurethane (NCO/OH mol ratio = 1.5) | $8 \times 10^{9}$ | −690 | −160 | Normal | None | None |
| Ex. 9 | Polyester polyurethane (NCO/OH mol ratio = 1.1) | $9 \times 10^{11}$ | −685 | −155 | Normal | None | None |
| Ex. 10 | Acrylic polyurethane (NCO/OH mol ratio = 1.1) | $4 \times 10^{11}$ | −690 | −160 | Noraml | None | None |
| Comp. Ex. 7 | Chloroprene*1 | $3 \times 10^{4}$ | −710 | −155 | Normal | *5 | *8 |
| Comp. Ex. 8 | Chloroprene*1 | $4 \times 10^{9}$ | "440 | −70 | Low | *6 | None |
| Comp. Ex. 9 | Nylon-66 | $8 \times 10^{13}$ | −420 | −80 | Low | *7 | None |
| Comp. Ex. 10 | Polyether polyurethane (NCO/OH mol ratio = 0.2) | $1 \times 10^{9}$ | −720 | −175 | Normal | *5 | None |
| Comp. Ex. 11 | Polyether polyurethane (NCO/OH mol ratio = 2.2) | $1 \times 10^{13}$ | −520 | −90 | Low | *7 | None |
| Comp. Ex. 12 | Polyether polyurethane (NCO/OH mol ratio = 2.5) | $7 \times 10^{13}$ | −440 | −80 | Low | *7 | None |

TABLE 4

| Example | Material for surface layer | Volume resistivity of surface layer (ohm · cm) (35° C. 90%) | Dark part potential (V) | Light part potential (V) | Image density | Image defect | Leak due to pin-hole |
|---|---|---|---|---|---|---|---|
| Ex. 6 | Polyether polyurethane (NCO/OH mol ratio = 1.2) | $9 \times 10^{9}$ | −675 | −145 | Normal | None | None |
| Ex. 7 | Polyether polyurethane (NCO/OH mol ratio = 2.0) | $1 \times 10^{10}$ | −655 | −130 | Normal | None | None |
| Ex. 8 | Polyether polyurethane (NCO/OH mol ratio = 1.5) | $5 \times 10^{8}$ | −680 | −135 | Normal | None | None |
| Ex. 9 | Polyester polyurethane (NCO/OH mol ratio = 1.1) | $2 \times 10^{10}$ | −670 | −130 | Normal | None | None |
| Ex. 10 | Acrylic polyurethane (NCO/OH mol ratio = 1.1) | $8 \times 10^{9}$ | −650 | −140 | Normal | None | None |
| Comp. Ex. 7 | Chloroprene*1 | $1 \times 10^{4}$ | −700 | −150 | Normal | *5 | *8 |
| Comp. Ex. 8 | Chloroprene*1 | $3 \times 10^{8}$ | −430 | −50 | Low | *6 | None |
| Comp. Ex. 9 | Nylon-66 | $4 \times 10^{12}$ | −260 | −70 | Low | *6 | None |
| Comp. Ex. 10 | Polyether polyurethane (NCO/KOH mol ratio = 0.2) | $7 \times 10^{5}$ | −270 | −95 | Low | *6 | None |
| Comp. Ex. | Polyether polyurethane (NCO/OH mol ratio = 2.2) | $4 \times 10^{11}$ | −300 | −100 | Low | *6 | None |
| Comp. Ex. | Polyether polyurethane (NCO/OH mol ratio = 2.5) | $9 \times 10^{12}$ | −210 | −80 | Low | *6 | None |

*1Chloroprene containing carbon dispersed therein.
*5Some black spots were observed.
*6Black fog was observed.
*7Many black spots were observed.
*8Lateral black streak occurred.

4. A member according to claim 3, wherein the base layer has a volume resistivity of $10^0$ to $10^{11}$ ohm.cm.

5. A member according to claim 1, wherein the raw material has a molar ratio between the isocyanate group and hydroxyl group satisfying the following relationship:

$$1.0 < (\text{mol of NCO group})/(\text{mol of OH group}) \leqq 1.5.$$

6. A member according to claim 1, wherein the surface layer has a thickness of 1-500 microns.

7. A charging member comprising a base layer and a surface layer disposed thereon; said base layer having a volume resistivity in the range of $10^0$-$10^{11}$ ohm.cm which is smaller than that of the surface layer; said surface layer having volume resistivity in the range of $10^6$-$10^{12}$ ohm cm and comprising a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

8. A member according to claim 7, wherein the raw material has a molar ratio between the isocyanate group and hydroxyl group satisfying the following relationship:

$$1.0 < (\text{mol of NCO group})/(\text{mol of OH group}) \leqq 1.5.$$

9. A device unit to be detachably disposed in an apparatus body, which comprises a photosensitive member and at least one charging member assembled together with the photosensitive member; said charging member comprising a surface layer which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

10. An electrophotographic apparatus comprising a photosensitive member, latent image-forming means for forming a latent image on the photosensitive member, means for developing the latent image to form a developed image, and means for transferring the developed image to a transfer material; said latent image-forming means comprising a charging member disposed in contact with the photosensitive member; said charging member comprising a surface layer which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

11. A facsimile comprising an electrophotographic apparatus and receiving means for receiving image information from a remote terminal; said electrophotographic apparatus comprising a photosensitive member, latent image-forming means for forming a latent image on the photosensitive member, means for developing the latent image to form a developed image, and means for transferring the developed image to a transfer material; said latent image-forming means comprising a charging member disposed in contact with the photosensitive member; said charging member comprising a surface layer which comprises a polyurethane resin prepared from a raw material for polyurethane containing an isocyanate group and a hydroxyl group; the raw material having a molar ratio between the isocyanate (NCO) group and hydroxyl group satisfying the following relationship:

$$1.0 < (\text{mol of NCO group})/(\text{mol of OH group}) \leqq 2.0.$$

* * * * *

UNITED STATES PATENT AND TRADEMARK OFFICE

CERTIFICATE OF CORRECTION

PATENT NO. : 5,017,965

DATED : May 21, 1991

INVENTOR(S) : Yuichi Hashimoto, et al

It is certified that error appears in the above-identified patent and that said Letters Patent is hereby corrected as shown below:

On the title page:

IN [56] REFERENCES CITED

FOREIGN PATENT DOCUMENTS, "1261675 10/1989 Japan" should read --1-261675 10/1989 Japan--.

COLUMN 3

Line 52, "printer" should read --printer.--.

COLUMN 5

Line 34, "of" should be deleted.

COLUMN 9

Line 18, "microns)," should read --microns,--.

COLUMN 11

TABLE 1, "Ex. 4 Polyether polyurethane" should read --Ex. 4 Polyester polyurethane-- and "Comp. Ex. 4 Polyether polyurethane
Comp. Ex. 5 Polyether polyurethane "

should read --Comp. Ex. 4 Polyether polyurethane (NCO/OH mol ratio = 0.2)
Comp. Ex. 5 Polyether polyurethane (NCO/OH mol ratio = 2.2)--.

UNITED STATES PATENT AND TRADEMARK OFFICE

CERTIFICATE OF CORRECTION

PATENT NO. : 5,017,965

DATED : May 21, 1991

INVENTOR(S) : Yuichi Hashimoto, et al

It is certified that error appears in the above-identified patent and that said Letters Patent is hereby corrected as shown below:

COLUMN 13

TABLE 2, "(NCO/KOH mol ratio = 0.2)" should read --(NCO/OH mol ratio = 0.2--.

COLUMN 14

Line 36, "resistivities" should read --resistivity--.

COLUMN 15

Line 28, "Table" should read --Tables--.
Line 45, "Table" should read --Tables--.
Line 62, "Table" should read --Tables--.

COLUMN 16

Line 44, "wa" should read --was--.

COLUMN 17

TABLE 4, "(NCO/KOH mol ratio = 0.2)" should read --(NCO/OH mol ratio = 0.2)--.

COLUMN 18

TABLE 3, ""440" should read -- -440-- and "Noraml" should read --Normal--.

UNITED STATES PATENT AND TRADEMARK OFFICE

CERTIFICATE OF CORRECTION

PATENT NO. : 5,017,965

DATED : May 21, 1991

INVENTOR(S) : Yuichi Hashimoto, et al

It is certified that error appears in the above-identified patent and that said Letters Patent is hereby corrected as shown below:

COLUMN 19

Line 18, "$10^6$-$10^{12}$ ohm cm" should read --$10^6$-$10^{12}$ ohm.cm--.

Signed and Sealed this

Nineteenth Day of January, 1993

*Attest:*

DOUGLAS B. COMER

*Attesting Officer*

*Acting Commissioner of Patents and Trademarks*